US006383662B1

(12) United States Patent
Frommeyer

(10) Patent No.: US 6,383,662 B1
(45) Date of Patent: May 7, 2002

(54) LIGHT WEIGHT STEEL AND ITS USE FOR CAR PARTS AND FACADE LININGS

(76) Inventor: Georg Frommeyer, Carl-Zuckmayer-Strasse 38, D-40699 Erkrath (DE)

( * ) Notice: Subject to any disclaimer, the term of this patent is extended or adjusted under 35 U.S.C. 154(b) by 0 days.

(21) Appl. No.: 09/254,059

(22) PCT Filed: Aug. 26, 1997

(86) PCT No.: PCT/EP97/04636

§ 371 Date: May 12, 2000

§ 102(e) Date: May 12, 2000

(87) PCT Pub. No.: WO98/08995

PCT Pub. Date: Mar. 5, 1998

(30) Foreign Application Priority Data

Aug. 27, 1996 (DE) ..... 196 34 524

(51) Int. Cl.[7] ..... B32B 15/18; C22C 38/06

(52) U.S. Cl. ..... 428/653; 420/77; 420/79; 420/80; 420/81; 420/83; 420/127; 428/457; 428/935; 428/936; 428/937; 428/938

(58) Field of Search ..... 428/653, 935, 428/936, 937, 938, 457; 420/77, 79, 80, 81, 83, 127

(56) References Cited

U.S. PATENT DOCUMENTS 4,334,923 A 6/1982 Sherman ..... 420/77

FOREIGN PATENT DOCUMENTS

| | | | |
|---|---|---|---|
| DE | 917 675 | | 9/1954 |
| DE | 72 770 | | 5/1970 |
| DE | 2 434 956 | | 3/1975 |
| DE | 26 56 076 A1 | | 3/1978 |
| EP | 0 495 123 A | | 7/1992 |
| EP | 0 540 792 A | | 5/1993 |
| GB | 1002057 A | * | 8/1965 |
| GB | 1 002 057 A | | 8/1965 |
| GB | 1 446 682 A | | 8/1976 |
| GB | 2 186 886 A | | 8/1987 |
| GB | 2186886 A | * | 8/1987 |
| JP | 4-318150 | | 11/1992 |

* cited by examiner

*Primary Examiner*—Robert R. Koehler
(74) *Attorney, Agent, or Firm*—Proskauer Rose LLP

(57) ABSTRACT

A high-strength lightweight steel and its use for car parts and facade linings is a purely ferritic steel having, in mass %, more than 5 to 9% Al, less than 0.2% Si, and 0.03 to 0.2% Mn.

6 Claims, 4 Drawing Sheets

Cyclic current-density - potential curves of a FeAl7 alloy by comparison with pure iron.

Cyclic current-density - potential curves of a FeAl 8.5 alloy with various electrolytic or thermal after-treatments.

Weight reduction of iron-aluminum alloys in comparison with conventional deep-draw steel types.

LIGHT WEIGHT STEEL AND ITS USE FOR CAR PARTS AND FACADE LININGS

BACKGROUND OF THE INVENTION

The invention relates to a high-strength lightweight steel and its use for car parts and facade linings.

All of the content indications below are in percentage of mass.

High-strength construction steel types have been developed for the vehicle industry with different properties and have already been used in production to a significant extent. A reduction in weight as compared with conventional soft steel can be obtained due to a reduction of sheet thickness thanks to greater strength. To ensure sufficient corrosion resistance, different surface coating processes were developed (Stahl-Eisen-Werkstoffblatt SEW 094 and SEW 093; Stahl und Eisen 106 (1986), No. 12, pages 21–38 and 114 (1994), No. 7, pages 47–53).

Steel types with greater aluminum content are known. Thus, EP-A-0 495 121 discloses steel with up to 7% Al, more than 0.5% Si, 0.1 to 8% Mn and less than 0.01% C, N, O, P for an attenuation of vibration and noise.

EP-A-0 401 098 takes steel types into account with less than 3.3% Si and 1.5 and 8% Al for soft magnetic sheets with a sharp (100) (001) texture (cube layer). Interstitial impurities must be below 50 ppm, C below 30 ppm. The texture used is unsuitable for deformation processes such as deep drawing and stretch forming.

DE 43 03 316 A describes steel types with 13 to 16% Al and in part larger contents in other alloy elements (Cr, Nb, Ta, W, Si, B, Ti) for oxidation and corrosion resistant parts.

DE 32 01 816 A indicates alloys with 1 to 10% Al for parts which come into contact with hydrocarbon-containing liquids at high temperatures (in the range of 750 to 900° C.) so that no hydrocarbon deposits occur. The surface of the parts can be pre-oxidized.

The above-described state of the art has the following disadvantages:

- Weight reduction can only be achieved by reducing the sheet thickness or through additional constructive and/or joining measures;
- The required corrosion protection can only be achieved by providing additional surface coatings.

Deep-drawn steel types containing greater amounts of aluminum which can be well formed or deep-drawn and stretch-drawn, cold rolled and annealed with re-crystallization, such as are needed in the automotive technology or as facade linings, are not part of the state of the art.

It is therefore the object of the present invention to create a steel with a density significantly below 7.6 g/cm$^3$, with greater strength and good cold formability and at the same time better resistance to atmospheric corrosion than conventional deep-drawn steel.

SUMMARY OF THE INVENTION

The purely ferritic steel according to the invention is characterized by more than 5 to 9% Al, <0.2% Si, 0.03 to 0.2% Mn, the remainder iron and impurities caused by melting, including up to a maximum of 1% in all of Cu+Mo+W+Co+Cr+Ni and a maximum of 0.1% in all of Sc+Y+rare earths. It may contain in addition

- up to 0.1% C
- up to 0.5% in all of Ti+Zr+Hf+V+Nb+Ta

- up to 0.01% B
- up to 0.1% P.

The aluminum content is preferably in a range between 7 and 9%. Furthermore the steel may be alloyed with titanium and/or niobium of at least 0.03%.

The following are special characteristics of the steel composition:

- the steel according to the invention is purely ferritic;
- it is limited to a maximum of 0.2% content in Si
- it contains a small amount of carbon, below 0.1% and no alloy-significant content in Cu, Mo, W, Co, Cr, Ni, Se Y and rare earth metals.

The steel according to the invention possesses an unexpectedly good combination of previously unknown, advantageous characteristics which can be described as follows:

- Strength characteristics are markedly higher than those of conventional, soft deep-drawn steel;
- Formability, as measured against strength, is comparatively good;
- Density is distinctly lower than that of conventional deep-drawn steel types;
- Corrosion resistance is considerably improved.

The deep-drawable and stretch-drawable steel with higher content in aluminum is melted down, is poured into a billet, rolled within a temperature range above re-crystallization temperature, or is poured off in form of a band. The steel is either processed directly as a hot band or is cold rolled after hot rolling, with a degree of deformation of more than 20%. The cold band is then re-crystallized and annealed.

Due to its good cold formability and low density, clearly below 7.6 g/cm$^3$, the steel in form of sheets is especially well suited for applications in the automotive industry and as facade linings.

BRIEF DESCRIPTION OF THE DRAWINGS

The invention is described in greater detail below through the example of embodiments shown in the drawings wherein.

DETAILED DESCRIPTION OF THE INVENTION

EXAMPLES

Figure 1:
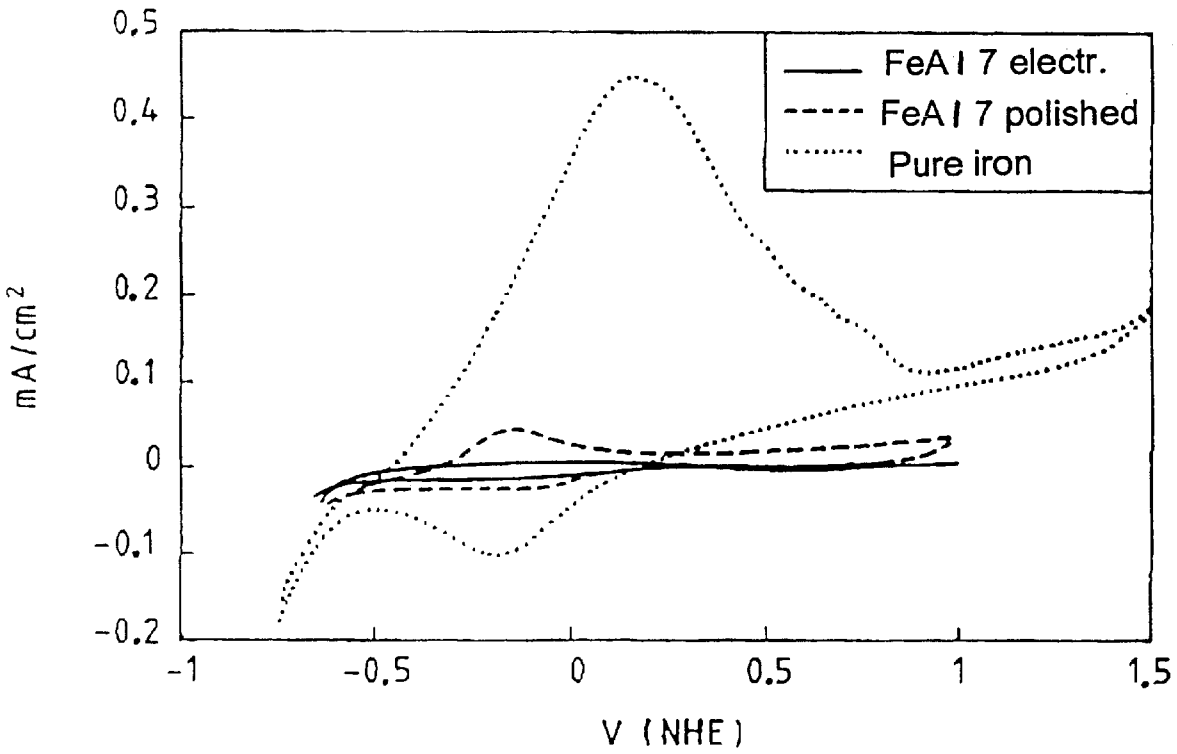
FIG. 1 is a graph showing cyclic current-density—potential curves of an inventive iron-aluminum alloy compared with pure iron.

The initial material was melted down in a vacuum induction oven and poured into casting dies. Hot rolling was carried out at a temperature ranging from 800° C. to 1100° C. on thicknesses of 4 mm. Following pickling, tablets between 5 and 92% were cold-rolled and then re-crystallized and annealed between 700° C. and 900° C. Table 1 indicates the chemical composition of several examined steel types.

TABLE 1

| Chemical composition In weight %, C, N, O in ppm | | | | | | | | | |
|---|---|---|---|---|---|---|---|---|---|
| Steel | C | Si | Mn | P | S | Al | N | O | Nb |
| 1 | 220 | 0.024 | 0.031 | 0.006 | 0.002 | 5.1 | 10 | n.b. | — |
| 2 | 130 | 0.024 | 0.034 | 0.008 | 0.002 | 7.0 | 15 | n.b. | — |
| 3 | 60 | 0.029 | 0.032 | 0.007 | 0.002 | 8.8 | 14 | n.b. | — |
| 4 | 39 | 0.01 | 0.10 | 0.008 | n.b. | 5.4 | 10 | n.b. | — |
| 5 | 39 | 0.01 | 0.12 | n.b. | n.b. | 7.9 | 8 | 34 | — |
| 6 | 36 | 0.01 | 0.14 | n.b. | n.b. | 9.0 | 5 | n.b. | — |
| 7 | 260 | 0.04 | 0.19 | 0.008 | 0.003 | 5.1 | 25 | n.b. | — |
| 8 | 270 | 0.08 | 0.19 | 0.012 | 0.003 | 7.8 | 24 | n.b. | — |
| 9 | 100 | n.b. | n.b. | n.b. | n.b. | 7.4 | 16 | 20 | 0.05 |
| 10 | 100 | n.b. | n.b. | n.b. | n.b. | 7.4 | 16 | 19 | 0.1 |
| 11 | 100 | n.b. | n.b. | n.b. | n.b. | 7.4 | 16 | 19 | 0.2 |
| 12 | 100 | n.b. | n.b. | n.b. | n.b. | 7.4 | 16 | 18 | 0.4 |

Table 2 shows the strength and formability characteristics of several examined types after 70% deformation in the annealed, re-crystallizing state. In this table:

$R_p$=stretching limit $R_m$=tensile strength

A80=extension, rod length 1=80 mm

E=elasticity module rL=r value (anisotropy value) in longitudinal sense n=n value (hardening index)

TABLE 2

| Strength and formability characteristics in longitudinal sense | | | | | | |
|---|---|---|---|---|---|---|
| Steel | $R_p$ (MPa) | $R_m$ (MPa) | A80 (%) | E (GPa) | rL value | n value |
| 1 | 340 | 440 | 28 | 190 | 0.79 | 0.195 |
| 2 | 390 | 490 | 28 | 180 | 0.73 | 0.175 |
| 3 | 440 | 540 | n.b. | 170 | 0.58 | 0.130 |
| 4 | 330 | 470 | 29 | 180 | 0.83 | 0.250 |
| 5 | 420 | 550 | 27 | 180 | 0.88 | 0.177 |
| 6 | 460 | 510 | n.b. | 170 | n.b. | n.b. |
| 7 | 380 | 470 | 25 | 190 | n.b. | n.b. |
| 8 | 480 | 570 | 22 | 180 | n.b. | n.b. |
| 9 | 400 | 490 | 25 | n.b. | n.b. | n.b. |
| 10 | 310 | 450 | 30 | n.b. | n.b. | n.b. |
| 11 | 300 | 460 | 24 | n.b. | n.b. | n.b. |
| 12 | 310 | 470 | 31 | n.b. | n.b. | n.b. |

Table 3 documents good strength and formability characteristics for samples in cold-rolled and annealed state, as well as for hot-rolled samples, among others A5—elongation at rupture 1=5 d.

TABLE 3

| Strength and Formability Characteristics in Transversal Sense | | | | | |
|---|---|---|---|---|---|
| Steel | $R_p$ (MPa) | $R_m$ (MPa) | A5 (%) | E (GPa) | n |
| 1 | 350 | 480 | 22 | 200 | 018 |
| 2 | 460 | 580 | 20 | 190 | 0.15 |
| 3 | 560 | 650 | n.b. | 180 | n.b |
| 4 | 330 | 460 | 29 | 200 | 0.18 |
| 5 | 390 | 510 | 27 | 190 | 0.16 |
| 6 | 480 | 550 | n.b. | 170 | n.b. |

Table 4 shows the influence of the cold rolling degree KVG in % of forming characteristics. It can be seen that as the cold rolling degree increases up to 70%, the r and n values increase significantly.

TABLE 4

| r and n value of the re-crystallizingly annealed steel 4 in function of the cold rolling degree KVG in % | | | | | | | | |
|---|---|---|---|---|---|---|---|---|
| KVG | 5 | 10 | 15 | 20 | 30 | 50 | 70 | 92 |
| rL | 0.7 | 0.56 | n.b. | 0.61 | 0.72 | 0.77 | 0.80 | 0.42 |
| n | 0.16 | 0.16 | 0.16 | 0.16 | 0.17 | 0.175 | 0.195 | 0.19 |

Table 5 shows the results of Erichsen swaging tests according to DIN 50101, which were conducted to determine formability characteristics relevant to practical applications.

TABLE 5

| Erichsen swaging test (stamp diameter + 20 mm) of the re-crystallizingly annealed steel types | | |
|---|---|---|
| Steel | Sheet thickness in mm | Swaging in mm |
| 1 | 0.98 | 9.6 |
| 1 | 0.96 | 10.0 |
| 1 | 0.97 | 9.5 |
| 4 | 1.10 | 9.7 |
| 4 | 1.10 | 9.9 |

FIG. 1 shows cyclic current-density - potential curves of iron-aluminum alloys by comparison with pure iron. An iron-aluminum alloy with a polished surface, i.e. without a protective oxide layer, possesses already a better corrosion resistance than pure iron. Through electrolytic bonification of the surface with aluminum, the good corrosion properties of iron-aluminum alloys can be further improved.

Figure 2:
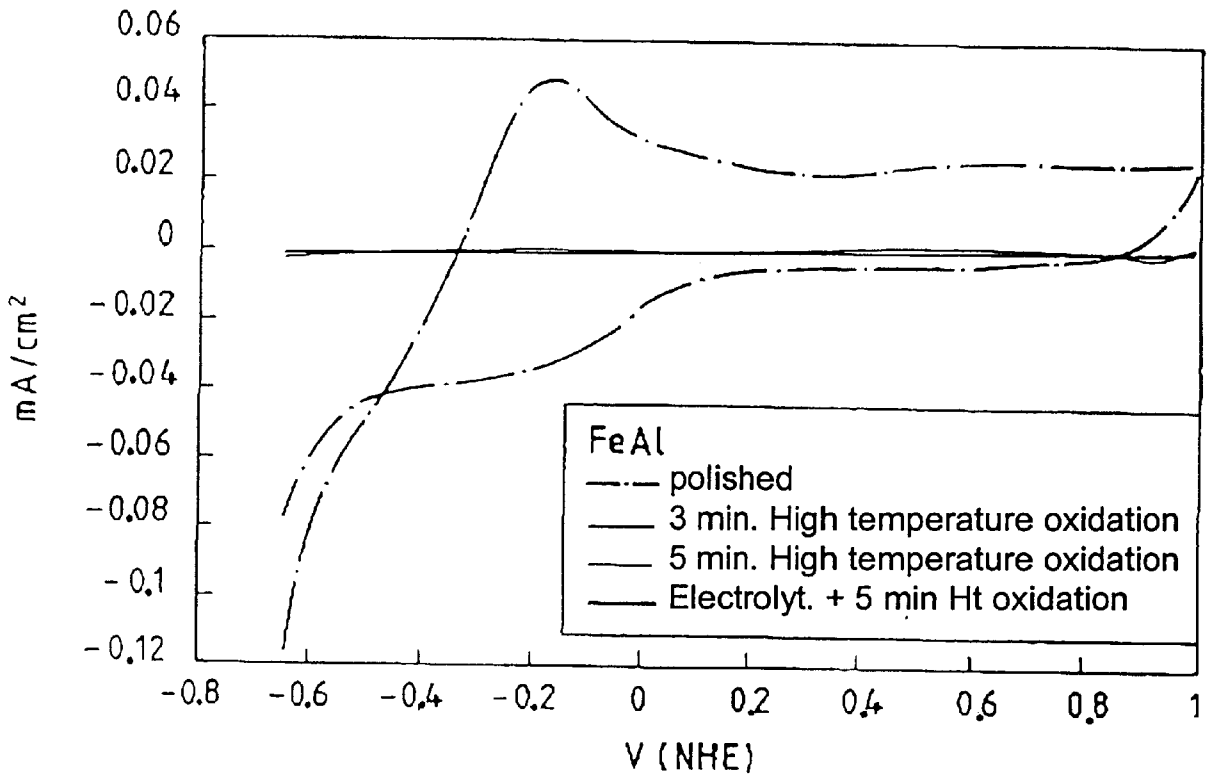
FIG. 2 is a graph showing cyclic current-density—potential curves of an inventive iron-aluminum alloy with various electrolytic or thermal after-treatments.

FIG. 2 shows that an electrolytic bonification with subsequent thermal treatment as compared with an alloy with polished surface, i.e. without protective oxide layer, tight and corrosion-proof surface layers can be produced in a very short time.

Figure 3:
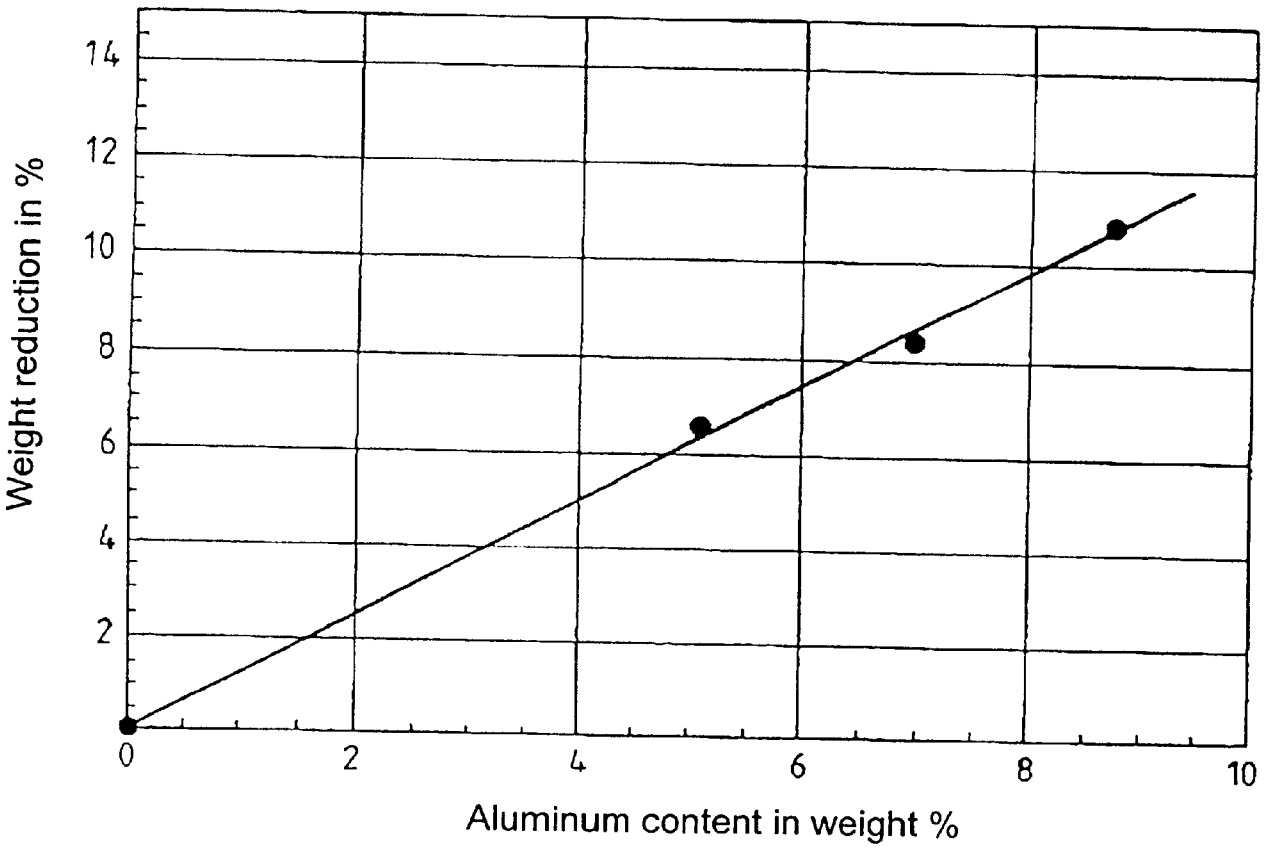
FIG. 3 is a graph showing weight reduction of inventive alloys in comparison with conventional deep-drawn steels.

In FIG. 3 the weight reduction of iron-aluminum alloys is entered as a function of the aluminum content. It becomes clear that with an aluminum content in the claimed range of 5 to 9% in the steel according to the invention, a weight reduction of 4.5 to 12% can be achieved.

Due to the strongly mixed crystal solidifying effect of aluminum in iron-aluminum alloys, and due to the presence of elements accompanying steel and micro alloy elements, the strength increases considerably as compared to micro-alloyed thin-sheet steel. In addition to good strength and formability characteristics accompanied by distinct weight reduction, the steel according to the invention is distinguished by greater resistance to corrosion. This can be improved even further through a chemical, electrochemical or thermal treatment, when the formation of an aluminum-rich surface layer results in the production of a protective $A1_2O_3$ covering layer.

Table 6 shows the increase of the aluminum content at the surface of an iron alloy with 8.5% Al improved on the surface with Al by electrolytic after-treatment at 20 and 60° C. in the active (−0.17 V against NHE), passive (1.1 V against NHE) and transpassive (10.65 V against NHE) range. In a comparison with the non-treated alloy an increase in aluminum concentration at the surface by almost 100% resulted. Identical results can also be achieved through electrochemical after-treatment with Al.

TABLE 6

Surface layer on an FeAl 8.5 alloy produced by electrolytical after-treatment, with Al bonification

| | Al/(Al + Fe) in At. % | | Increase of Al at the surface in % | |
|---|---|---|---|---|
| Polarization | 20° C. | 60° C. | 20° C. | 60° C. |
| active | 21.1 | 19.3 | 28.7 | 17.7 |
| passive | 18.9 | 29.4 | 15.2 | 79.3 |
| transpassive | 29.9 | 32.3 | 82.3 | 96.3 |
| polished sample | 16.4 | | | |

Figure 4:
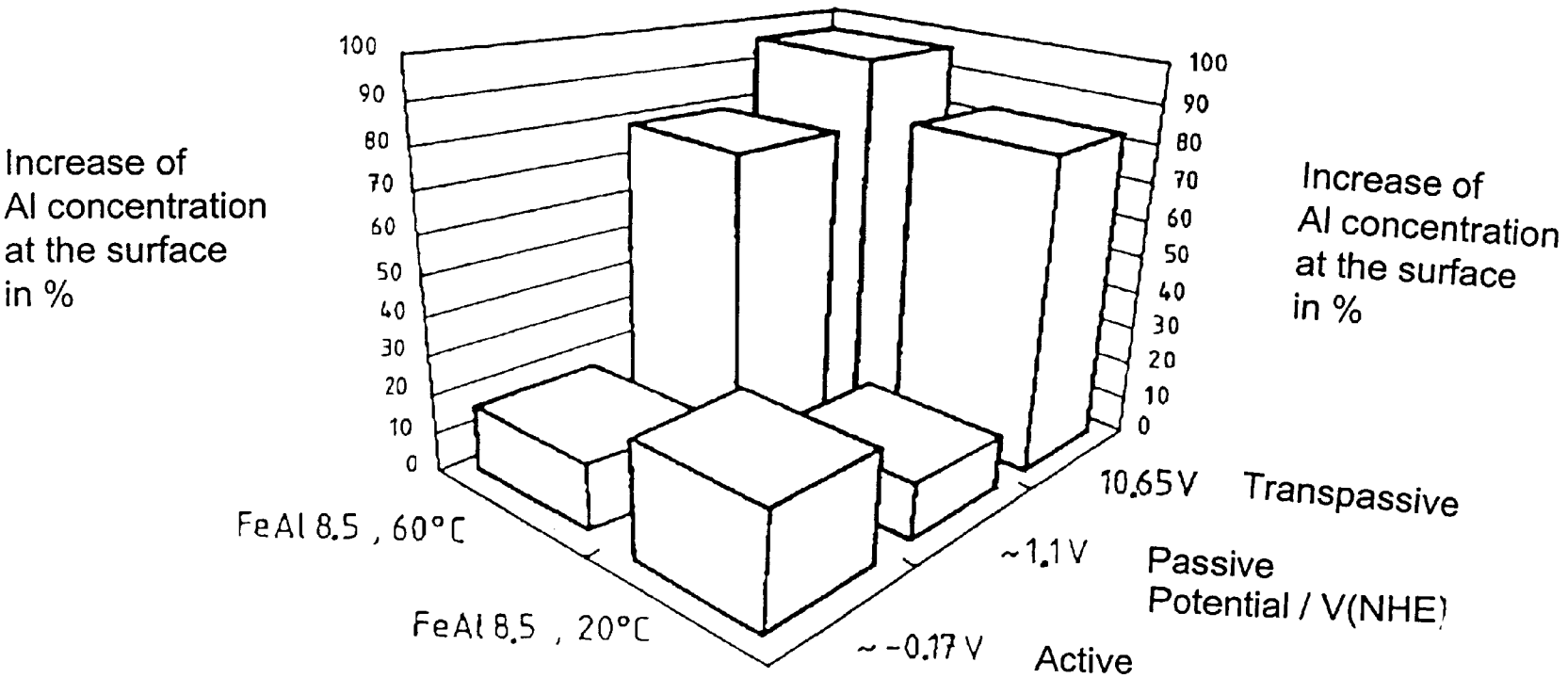
FIG. 4 is a bar graph showing the increase in aluminum content at the surface of inventive alloys.

FIG. 4 is a bar graph which plots the values listed in Table 6.

Dense $Al_2O_3$ layers can be constituted through suitable thermal after-treatment at higher temperature (600 to 1200° C.).

What is claimed is:

1. Vehicle parts and facade linings made from high-strength lightweight steel comprising (in mass %):

more than 5 to 9% Al,

<0.2% Si, 0.03 to 0.2% Mn, remainder iron and impurities caused by melting including a maximum of 1% of Cu+Mo+W+Co+Cr+Ni and up to 0.1% of Sc+Y+rare earth metals.

2. The vehicle parts and facade linings of claim 1 further comprising (in mass %):

a maximum of 0.1% C;

a maximum of 0.5% of Ti+Zr+Hf+V+Nb+Ta;

a maximum of 0.01% B; and a maximum of 0.1% P.

3. The vehicle parts and facade linings of claim 2, wherein the total content of titanium and niobium is at least 0.03%.

4. The vehicle parts and facade linings of claim 1, wherein the content of Al is in the range of 7 to 9%.

5. The vehicle parts and facade linings of claim 1, further comprising bands provided with a chemical, electrochemical, organic non-metallic or metallic coating.

6. The vehicle parts and facade linings of claim 5 wherein the bands are coated with aluminum.

* * * * *